US008607593B2

(12) United States Patent
Lee

(10) Patent No.: US 8,607,593 B2
(45) Date of Patent: Dec. 17, 2013

(54) SEAMLESS KNIT BELT

(75) Inventor: Eun Kyung Lee, Rocky Hill, CT (US)

(73) Assignee: Habasit AG, Reinach (CH)

( * ) Notice: Subject to any disclaimer, the term of this patent is extended or adjusted under 35 U.S.C. 154(b) by 568 days.

(21) Appl. No.: 12/660,488

(22) Filed: Feb. 26, 2010

(65) Prior Publication Data

US 2010/0218562 A1 Sep. 2, 2010

(51) Int. Cl.
*D04B 9/42* (2006.01)

(52) U.S. Cl.
USPC ..... 66/170; 66/200; 66/202

(58) Field of Classification Search
USPC ..... 66/169 R, 170, 172 R, 176, 175, 177, 66/197, 200, 202
See application file for complete search history.

(56) References Cited

U.S. PATENT DOCUMENTS

| | | | | | |
|---|---|---|---|---|---|
| 2,330,405 | A | | 9/1943 | Case | |
| 3,853,017 | A | * | 12/1974 | White et al. | 474/238 |
| 5,616,090 | A | * | 4/1997 | McGee et al. | 474/267 |
| 5,645,504 | A | * | 7/1997 | Westhoff | 474/250 |
| 6,572,505 | B1 | * | 6/2003 | Knutson | 474/260 |
| 7,523,626 | B2 | * | 4/2009 | Enzien et al. | 66/195 |

FOREIGN PATENT DOCUMENTS

| | | | |
|---|---|---|---|
| GB | 2462205 A | * | 2/2010 |
| WO | 2010/013020 A2 | | 2/2010 |

* cited by examiner

*Primary Examiner* — Danny Worrell
(74) *Attorney, Agent, or Firm* — Hodgson Russ LLP

(57) ABSTRACT

A method for making a seamless knit belt including forming two longitudinal rib sections that are formed from a different material than the body of the belt. The rib sections are formed during the tubular knitting process and then the body of the knit composite is run through a polymeric treating system. After the body is treated, the rib sections are trimmed from the edges and the resulting product is a coated seamless knit belt.

7 Claims, 2 Drawing Sheets

SEAMLESS KNIT BELT

CROSS-REFERENCE TO RELATED APPLICATION

The present invention claims priority benefit of U.S. Provisional Patent Application No. 61/208,851 filed on Feb. 27, 2009, which is incorporated herein by reference.

FIELD OF THE INVENTION

The present invention pertains generally to endless belts and particularly to seamless knit belts.

BACKGROUND OF INVENTION

Seamless belts are typically used where extreme flexibility or exact dimensions are required. Some common applications for seamless belts include paper and currency processing, packaging, business machines, fiber optics, general power transmission or the like. Unlike other endless belts, there is no splice or seam where the opposite ends are connected. The seamless belts are formed on tubular machines. For seamless knit belts, there is a well known issue with regard to curling along the edges because of the direction of the knitted loops. Accordingly, there is a need for a method of making seamless knit belts that addresses edge curling.

SUMMARY OF INVENTION

The present invention meets the above-described need by providing a method of making a seamless knit belt. The method includes forming two longitudinal rib sections that are formed from a different material than the body of the knit composite. The rib sections are formed during the tubular knitting process and then the body of the knit composite is run through a polymeric treating system. After the body is treated, the rib sections are trimmed from the edges and the resulting product is a treated seamless knit belt.

BRIEF DESCRIPTION OF THE DRAWING FIGURES

The invention is illustrated in the drawings in which like reference characters designate the same or similar parts throughout the figures of which:

DETAILED DESCRIPTION OF THE INVENTION

Figure 1:
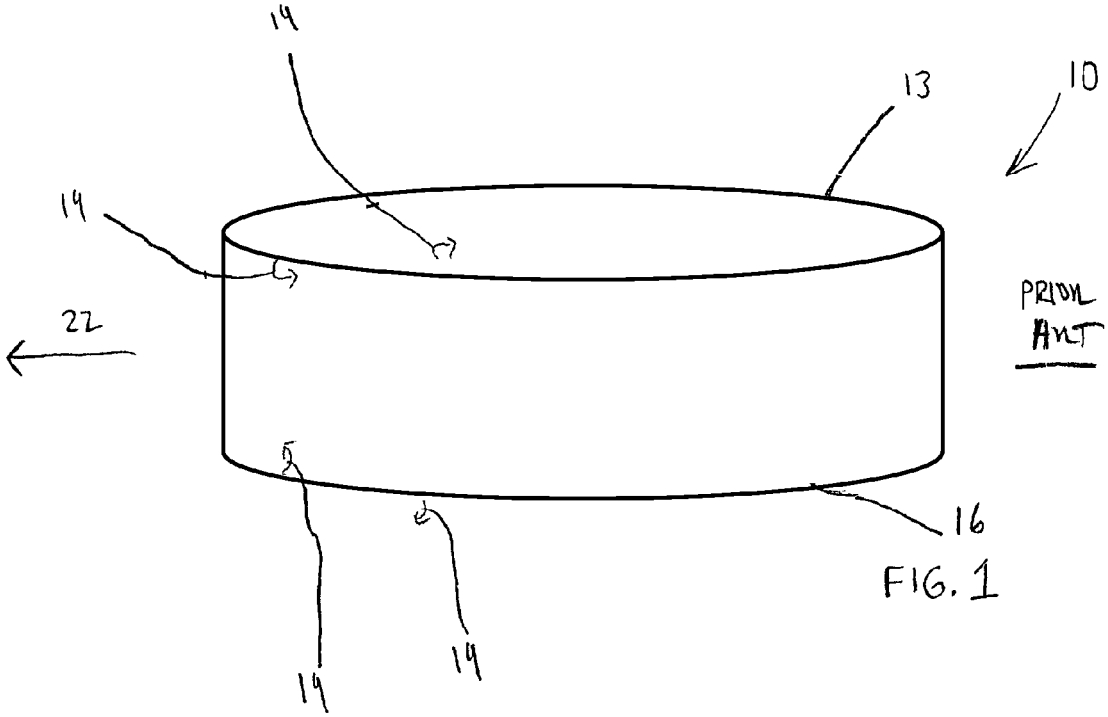
FIG. 1 is a perspective view of a prior art tubular knit composite.

Turning to FIG. 1, one type of seamless belt 10 is constructed with a tubular knit composite. The composite is produced on a tubular knitting machine as known to those of ordinary skill in the art based on this disclosure. The knit composite is first knit into a tubular shape with a pair of edges (13, 16) disposed in spaced apart parallel relation. Because of the well known tendency of knit tubing to curl at the edges (indicated by arrows 19) due to the direction of the knitted loops, there can be difficulties with further processing of the composite. For example, after the tubular composite is formed, the body of the composite may be treated with a rubber, silicone or similar material for some belt applications.

During the treating process, the knit composite may be run in a machine direction indicated by arrow 22 and run through a treating system containing the polymeric material. The body of the composite may be treated in a rotational method such as knife coating as will be evident to those of ordinary skill in the art based on this disclosure.

Figure 2:
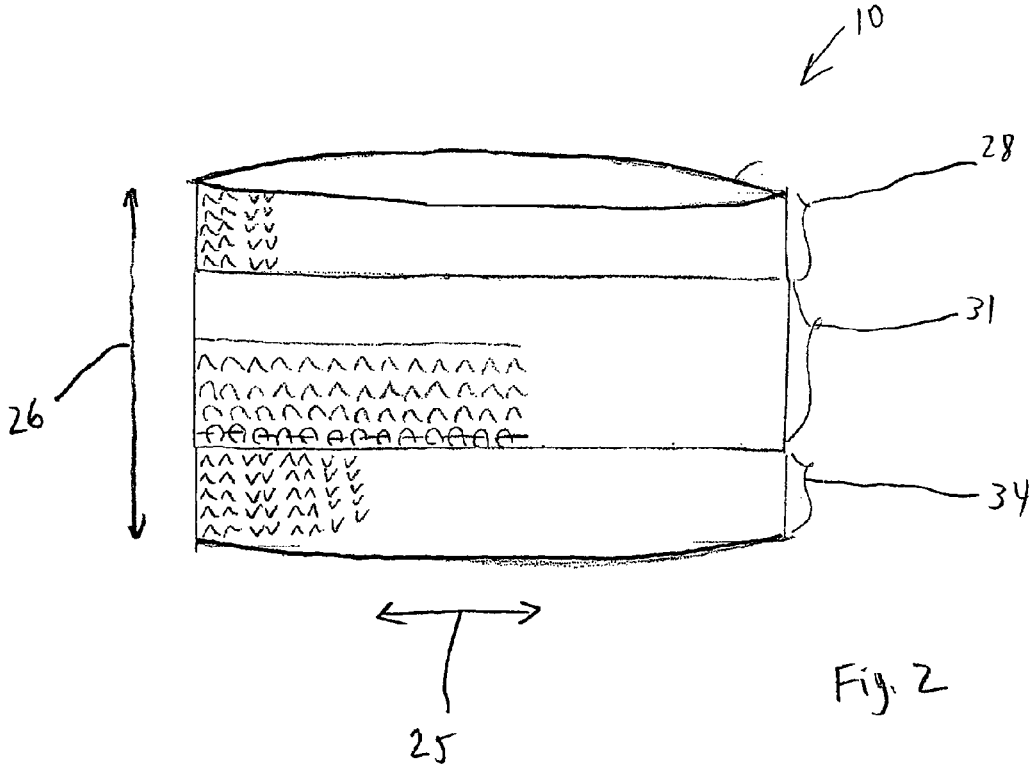
FIG. 2 is a perspective view of a tubular knit composite of the present invention; and, FIG. 3 is a block diagram showing the steps of the method of the present invention.

Turning to FIG. 2, the seamless belt 10 of the present invention is divided into three sections in the transverse direction indicated by arrow 26. The first section 28 is a rib portion that is knitted from a different material such as a monofilament yarn to increase the stiffness of the composite and prevent edge curling in this area. The second or body section 31 is constructed of a different material than the first section 28, and in some cases the second section 31 comprises a different knit pattern. The body section 31 is constructed according to the specifications for the final seamless knit belt product. The third section 34 is also knitted from a monofilament or other material that is selected for greater stiffness and resistance to edge curling. After the composite knit substrate is formed as described, the body of the composite is treated with a polymeric material as described above. The web may be conveyed through the treating system in the machine direction indicated by arrow 25 by rotating it around drums or sprockets that support the web at opposite ends. After the treating step is completed and the polymer has cured, the first section 28 and the third section 34 are trimmed away by an edge trimming device as will be evident to those of ordinary skill in the art based on this disclosure. After the first and third sections 28 and 34 are trimmed away from the body section 31, the resulting product is a treated seamless knit belt.

Figure 3:
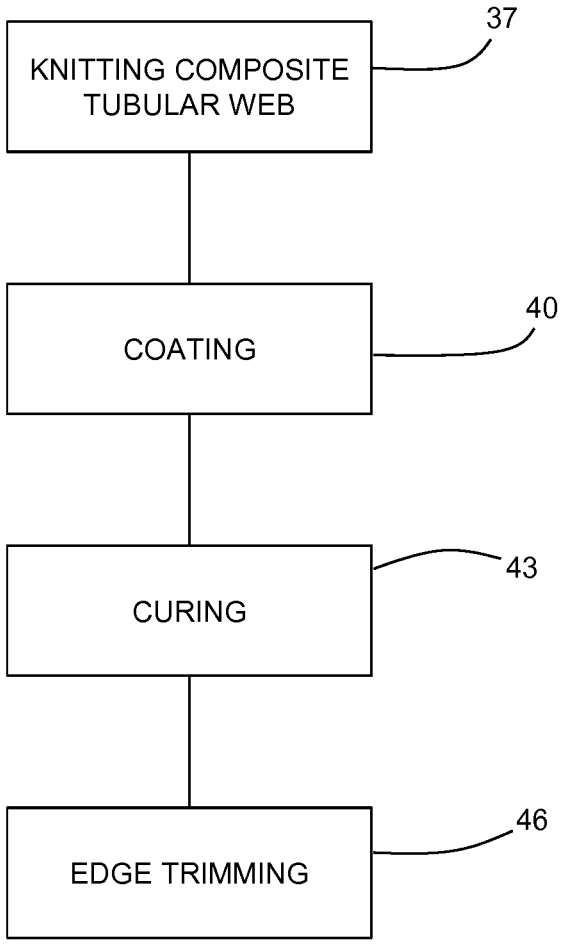

Turning to FIG. 3, a block diagram shows the steps of the method of the present invention. In step 37, the composite tubular knit is formed with a body section surrounded by two rib sections extending from the body section in the transverse direction. In the next step 40, the body of the composite is treated with a polymeric coating substance. Next, the body is cured in step 43. After the curing step, the edges are trimmed in the final step 46.

While the invention has been described in connection with certain embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A method of forming a seamless belt, comprising:

knitting a tubular composite having a body section formed from a tubular knit material having a first stiffness, a pair of rib portions disposed on opposite sides of the body section, the rib portions formed from a tubular knit material having a second stiffness that is greater than the first stiffness to form a tubular knit composite; and, treating at least a portion of the tubular knit composite with a polymeric material to form a treated tubular knit composite;

curing the treated tubular knit composite web to form a cured tubular knit composite; and trimming the edges of the cured tubular knit composite to remove the rib portions from the body section.

2. The method of claim 1, wherein the rib portions are knitted from monofilament yarns.

3. The method of claim 1, wherein the rib portions are formed integrally with the rib portion during a single tubular knitting process.

4. The method of claim 1, wherein the rib portions have a different knit pattern than the body section.

5. The method of claim 1, wherein the body section is treated with a polymer.

6. The method of claim 1, wherein the body section is treated with a polymer by coating.

7. The method of claim 1, wherein the pair of rib portions are knitted from different materials.

* * * * *

UNITED STATES PATENT AND TRADEMARK OFFICE

CERTIFICATE OF CORRECTION

PATENT NO. : 8,607,593 B2
APPLICATION NO. : 12/660488
DATED : December 17, 2013
INVENTOR(S) : Lee It is certified that error appears in the above-identified patent and that said Letters Patent is hereby corrected as shown below:

Title page, after item (65) should read:

Item --(60) Related U.S. Application Data
Provisional application No. 61/208,851, filed on Feb. 27, 2009.--

Signed and Sealed this
Twenty-fifth Day of February, 2014

Michelle K. Lee

Michelle K. Lee
*Deputy Director of the United States Patent and Trademark Office*